US011607103B2

(12) United States Patent
Deng et al.

(10) Patent No.: US 11,607,103 B2
(45) Date of Patent: Mar. 21, 2023

(54) ROBOT MAINTENANCE STATION AND ROBOT CLEANING SYSTEM

(71) Applicant: SHENZHEN SILVER STAR INTELLIGENT GROUP CO., LTD., Shenzhen (CN)

(72) Inventors: Wenhai Deng, Shenzhen (CN); Changtai Xia, Shenzhen (CN); Ruijun Yan, Shenzhen (CN); Shusheng Huang, Shenzhen (CN)

(73) Assignee: SHENZHEN SILVER STAR INTELLIGENT GROUP CO., LTD., Shenzhen (CN)

( * ) Notice: Subject to any disclaimer, the term of this patent is extended or adjusted under 35 U.S.C. 154(b) by 238 days.

(21) Appl. No.: 16/992,351

(22) Filed: Aug. 13, 2020

(65) Prior Publication Data

US 2021/0282617 A1 Sep. 16, 2021

(30) Foreign Application Priority Data

Mar. 12, 2020 (CN) ..... 202010170185.6

(51) Int. Cl.
*A47L 11/40* (2006.01)

(52) U.S. Cl.
CPC ..... *A47L 11/4091* (2013.01); *A47L 11/4011* (2013.01); *A47L 11/4025* (2013.01); *A47L 11/4044* (2013.01); *A47L 11/4072* (2013.01); *A47L 2201/024* (2013.01)

(58) Field of Classification Search
CPC ..... A47L 11/4091; A47L 11/4011; A47L 11/4025; A47L 11/4044; A47L 11/4072; A47L 2201/024; A47L 9/19; A47L 9/28; A47L 9/2805
See application file for complete search history.

(56) References Cited

U.S. PATENT DOCUMENTS

2010/0107355 A1 5/2010 Won et al.
2021/0068604 A1* 3/2021 So ..... A47L 9/19

FOREIGN PATENT DOCUMENTS

| | | | | |
|---|---|---|---|---|
| CN | 107595207 | A | | 1/2018 |
| CN | 109480714 | A | * | 3/2019 |
| CN | 208864918 | U | | 5/2019 |
| CN | 110051283 | A | | 7/2019 |
| CN | 110432830 | A | | 11/2019 |
| CN | 110664321 | A | | 1/2020 |
| CN | 110754991 | A | | 2/2020 |
| KR | 20110041721 | A | * | 4/2011 |

* cited by examiner

*Primary Examiner* — David Redding
(74) *Attorney, Agent, or Firm* — Maier & Maier, PLLC

(57) ABSTRACT

A robot maintenance station and a robot cleaning system. The robot maintenance station includes a dock base and a maintenance station body, the maintenance station body is configured on the dock base and provided with a suction unit, the suction unit is configured to provide suction power for sucking garbage. The maintenance station body is provided with a garbage receptacle and a suction tube, the suction tube is in flow communication with the suction unit and is configured to guide the garbage into the garbage receptacle, and the garbage receptacle is detachably mounted at a side wall of the maintenance station body. The embodiments realize automatic emptying of the dust box of the cleaning robot, thereby reducing user burden and improving user experience.

18 Claims, 7 Drawing Sheets

ROBOT MAINTENANCE STATION AND ROBOT CLEANING SYSTEM

CROSS REFERENCE TO RELATED APPLICATIONS

This application claims priority to Chinese Patent Application No. 202010170185.6 filed on Mar. 12, 2020, the content of which is incorporated herein by reference.

FIELD

The present application relates to the field of cleaning robots, and in particular to a robot maintenance station and a robot cleaning system.

BACKGROUND

In the 21st century, artificial intelligence products, including sweeping robots, have attracted more and more attention. The sweeping robots are mainly used to help humans clean indoor ground environments. In general, the sweeping robot will be equipped with a dust box used to accommodate garbage and particulate matter inhaled by the sweeping robot, and the dust box of the current sweeping robot is mainly configured by two manners. The first manner is to install the dust box at a rear portion of the sweeping robot, this kind of dust box is usually removed by rear extraction and occupies little space of the sweeping robot, therefore the garbage that can be accommodated in a single use is relatively small. The second manner is to arrange a groove at a middle portion of the sweeping robot and the dust box is arranged in the middle groove, this kind of dust box can accommodate slightly more garbage than that of the first kind in a single use, however, the dust box arranged at the middle portion of the sweeping robot occupies relatively larger space of the sweeping robot, which results in tighter mounting space for other components. After the dust box of most sweeping robots is filled with garbage, users need to remove the dust box to clean out the garbage in the dust box by themselves, resulting in poor user experience. Therefore, the existing technologies need to be improved.

SUMMARY

According to an aspect of the present application, an embodiment of the present disclosure provides a robot maintenance station for maintenance of a cleaning robot, comprising:

a dock base, configured to be dockable with the cleaning robot, a maintenance station body, arranged in operable connection with the dock base and provided with a suction unit, wherein the suction unit is configured to provide suction power for sucking garbage, wherein the maintenance station body is provided with a garbage receptacle and a suction tube, the suction tube is in flow communication with the suction unit and is configured to guide the garbage into the garbage receptacle, and the garbage receptacle is removably mounted at a side wall of the maintenance station body.

According to another aspect of the present application, an embodiment of the present disclosure provides a robot cleaning system, comprising a cleaning robot and the robot maintenance station, wherein the cleaning robot comprises a robot body, and a bottom of the robot body is provided with a driving unit, and wherein the driving unit is configured to be dockable with the cleaning robot to move on a surface to be cleaned.

Compared with the existing technologies, the present application has at least the following beneficial effects: a robot maintenance station for maintenance of a cleaning robot includes a dock base and a maintenance station body, the dock base is configured to receive the cleaning robot and arranged on the dock base, the maintenance station body is provided with a suction unit configured to provide suction power for sucking garbage, wherein the maintenance station body is provided with a garbage receptacle and a suction tube, the suction tube is in flow communication with the suction unit and is configured to guide the garbage into the garbage receptacle, and the garbage receptacle is detachably mounted at a side wall of the maintenance station body. On the one hand, the robot maintenance station of the present application sucks the garbage in the cleaning robot into the garbage receptacle through the suction unit to realize automatic emptying of the dust box of the cleaning robot, thereby reducing the user burden and improving the user experience. On the other hand, through arranging a detachable garbage receptacle on the side wall of the maintenance station body, when the garbage receptacle is filled with garbage, the garbage receptacle can be pulled out from the side of the robot maintenance station to handle the garbage in the robot maintenance station, the operation of which is simple and convenient, and is helpful for users to clean up and maintain the robot maintenance station regularly.

Figure 1:
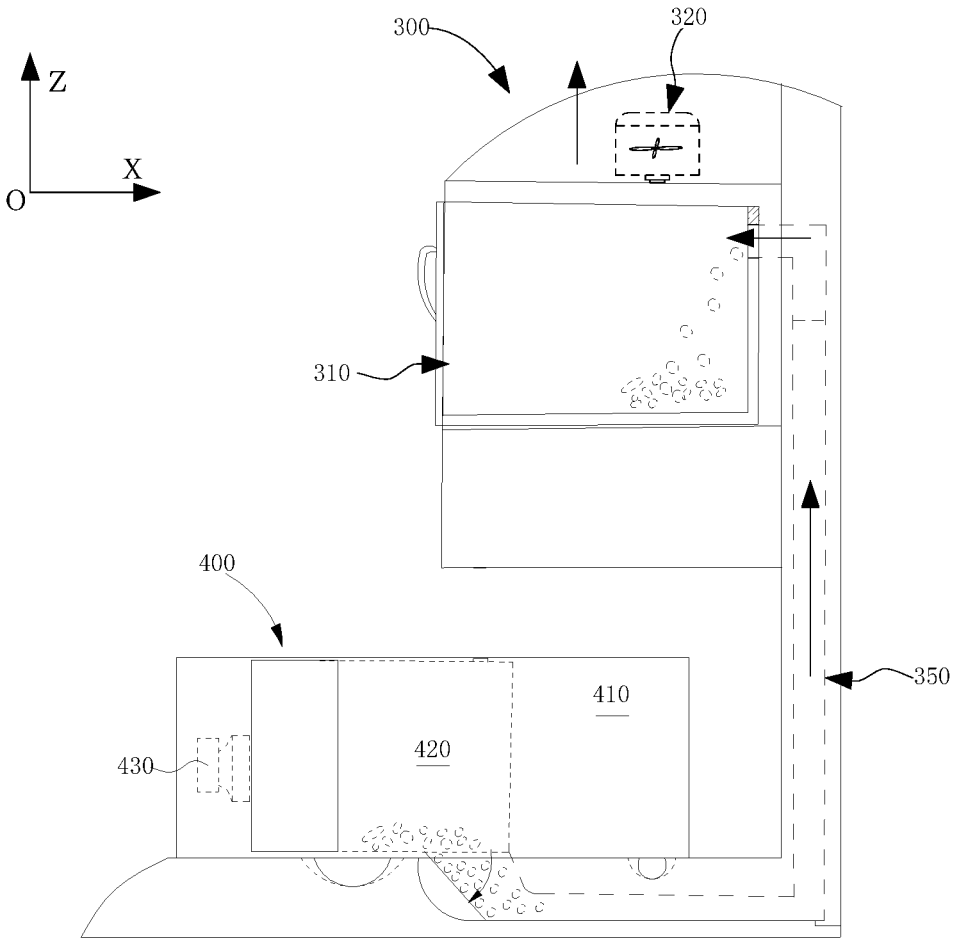
FIG. 1 is a schematic diagram of the robot maintenance station and the cleaning robot provided by an embodiment of the present application.

DESCRIPTION OF REFERENCE SIGNS robot maintenance station 100; dock base 200; sunken portion 210; garbage receiving port 220; pressure sensor 230; maintenance station body 300; garbage receptacle 310; suction unit 320; garbage bag 330; lateral plate 331; flexible rubber seal 332; stand 340; suction tube 350; cleaning robot 400; robot body 410; dust box 420; fan unit 430.

DETAILED DESCRIPTION OF THE EMBODIMENTS

In order to make the technical problems solved by the present application, technical solutions and beneficial effects be clearly understood, the present application will be further described in detail below with reference to the accompanying drawings and embodiments. It should be understood that the specific embodiments described herein are only used to explain the present application, but not to limit the present application.

The embodiments of the present application are described in detail below. Examples of the embodiments are shown in the accompanying drawings, in which the same or similar reference signs indicate the same or similar elements or elements with the same or similar functions. The embodiments described below with reference to the accompanying drawings are exemplary, and are intended to explain the present application, but should not be construed as limitations to the present application.

In the description of the present application, it should be understood that the orientation or positional relationship indicated by the term "transversal", "length", "width", "upper", "lower", "front", "rear", "left", "right", "vertical", "horizontal", "top", "bottom", "clockwise", "counterclockwise", or the like is based on the orientation or positional relationship as shown in the drawings, and is only for ease of description of the present application and simplification of the description, rather than indicating or implying that a specific unit or element must have a specific orientation, or be constructed and operated in a specific orientation. Therefore, the orientation or positional relationship cannot be understood as a limitation to the present application.

In addition, the terms "first" and "second" are only used for descriptive purposes, and cannot be understood as indicating or implying relative importance or implicitly indicating the number of a specific technical feature. Therefore, the feature defined with "first" or "second" may explicitly or implicitly includes at least one of the features. In the description of the present application, "a plurality of" is equal to at least two, such as two, three, etc., unless otherwise specifically defined.

In the present application, unless otherwise clearly defined and limited, the terms "installation", "connection", "link", "fixation" and the like should be understood in a broad sense, for example, the connection may be fixed connection or detachable connection, or integrated connection; the connection may be mechanical connection or electrical connection; the connection may be direct connection or indirect connection through an intermediary, alternatively, the connection may be internal communication of two components or interaction relationship between two components, unless otherwise explicitly limited. For those of ordinary skill in the art, the specific meanings of the above terms in the present application can be understood according to specific circumstances.

In the present application, unless otherwise clearly defined and limited, that the first feature is "on" or "under" the second feature may mean that the first feature is in direct contact with the second feature, or the first feature and the second feature are indirectly contanted through an intermediary. Moreover, that the first feature is "on", "above", "onto" the second feature may mean that the first feature is directly above or obliquely above the second feature, or simply mean that the first feature has a higher level than the second feature. That the first feature is "under", "below", "underneath" the second feature may mean that the first feature is directly below or obliquely below the second feature, or simply mean that the first feature has a lower level than the second feature.

The following technical solution is adopted in an embodiment of the present application.

A robot maintenance station for maintenance of a cleaning robot, comprising:

a dock base, configured to be dockable with the cleaning robot, a maintenance station body, arranged in operable connection with the dock base and provided with a suction unit, wherein the suction unit is configured to provide suction power for sucking garbage, wherein the maintenance station body is provided with a garbage receptacle and a suction tube, the suction tube is in flow communication with the suction unit and is configured to guide the garbage into the garbage receptacle, and the garbage receptacle is removably mounted at a side wall of the maintenance station body.

Optionally, an opening is provided on the maintenance station body to form an accommodating cavity, and the garbage receptacle is removably mounted in the accommodating cavity.

Optionally, the opening is provided along a horizontal direction on the side wall of the maintenance station body to form an accommodating cavity, and the garbage receptacle is removably mounted in the accommodating cavity.

Optionally, the robot maintenance station comprises a sliding assembly which is configured to reduce the frictional force when the garbage receptacle is moving relative to the maintenance station body.

Optionally, the robot maintenance station comprises a sliding assembly comprising a first sliding member and a second sliding member, the first sliding member is arranged to slide on the second sliding member, the first sliding member is arranged outside the garbage receptacle, and the second sliding member is arranged on an inner wall of the receiving cavity.

Optionally, the garbage receptacle is provided with a docking port, and one end of the suction tube extends into the docking port and is connected to the docking port in a sealed manner when the garbage receptacle is mounted in the receiving cavity.

Optionally, the garbage receptacle is provided with a docking portion protruding out from the garbage receptacle, when the garbage receptacle is mounted in the receiving cavity, the docking portion mates with one end of the suction tube close to the garbage receptacle to form a sealed connection.

Optionally, the garbage receptacle is provided with a garbage bag and a stand, the garbage bag is configured to store the garbage sucked in by the suction unit, and the garbage bag is detachably mounted on the stand.

Optionally, the garbage bag comprises a bag mouth, when the garbage receptacle is mounted in the receiving cavity, one end of the suction tube close to the garbage receptacle extends into the bag mouth, the bag mouth is provided with a flexible rubber seal, and the flexible rubber seal is composed of a plurality of deformable fan blades.

Optionally, the suction unit is in flow communication with the garbage receptacle, the garbage receptacle is provided with a strainer unit, and the suction unit is arranged above or below the garbage receptacle.

An embodiment provides a robot cleaning system, comprising a cleaning robot and a robot maintenance station;

wherein the robot maintenance station comprising:

a dock base, configured to be dockable with the cleaning robot, and a maintenance station body, arranged in operable connection with the dock base and provided with a suction unit, wherein the suction unit is configured to provide suction power for sucking garbage, wherein the maintenance station body is provided with a garbage receptacle and a suction tube, the suction tube is in flow communication with the suction unit and is configured to guide the garbage into the garbage receptacle, and the garbage receptacle is removably mounted at a side wall of the maintenance station body.

wherein the cleaning robot comprises a robot body, and a bottom of the robot body is provided with a driving unit, and wherein the driving unit is configured to be dockable with the cleaning robot to move on a surface to be cleaned.

Optionally, the cleaning robot comprises a controller, a dust box, and a dust sensor, the dust sensor is configured to detect garbage volume in the dust box, the controller is electrically connected to the dust sensor, and the controller is at least configured to control the cleaning robot to move toward the robot maintenance station when the garbage volume reaches a threshold.

Optionally, the robot maintenance station comprises a signal transmitter for sending a docking signal, the cleaning robot comprises a signal receiver for receiving the docking signal, and the controller is at least configured to control the cleaning robot to be docked with the robot maintenance station according to the docking signal.

Optionally, the dust box is provided with a garbage discharge port, the robot maintenance station is provided with the garbage receiving port, and the garbage discharge port is aligned with the garbage receiving port when the cleaning robot moves to the dock base and is docked with the robot maintenance station.

Optionally, the robot maintenance station comprises a control module, and the dock base is provided with a position detection sensor, when the cleaning robot moves to the dock base and is docked with the robot maintenance station, the driving unit triggers the position detection sensor, the position detection sensor transmits an electric signal to the control module, and the control module controls the suction unit of the robot maintenance station to suck in garbage.

Optionally, wherein an opening is provided on the maintenance station body to form an accommodating cavity, and the garbage receptacle is removably mounted in the accommodating cavity.

Optionally, the opening is provided along a horizontal direction on the side wall of the maintenance station body to form an accommodating cavity, and the garbage receptacle is removably mounted in the accommodating cavity.

Optionally, the robot maintenance station comprises a sliding assembly which is configured to reduce the frictional force when the garbage receptacle is moving relative to the maintenance station body.

Optionally, the garbage receptacle is provided with a docking port, and one end of the suction tube extends into the docking port and is connected to the docking port in a sealed manner when the garbage receptacle is mounted in the receiving cavity.

Optionally, the garbage receptacle is provided with a docking portion protruding out from the garbage receptacle, when the garbage receptacle is mounted in the receiving cavity, the docking portion mates with one end of the suction tube close to the garbage receptacle to form a sealed connection.

The present application will be further described below in conjunction with the drawings and embodiments.

The present application provides a robot maintenance station 100 for maintaining a cleaning robot 400. Please refer to FIG. 1. FIG. 1 is a schematic diagram of the robot maintenance station 100 and the cleaning robot 400 according to an embodiment of the present application. The robot maintenance station 100 includes:

a dock base 200 configured to be docked with the cleaning robot 400 and configured with a ramp with a certain inclination angle for crawl of the cleaning robot 400 along the ramp, such that the cleaning robot 400 is docked with the robot maintenance station 100, a maintenance station body 300 configured in operable connection with the dock base 200, such as aligned on the dock base 200, and provided with a suction unit 320, among which the suction unit 320 is configured to provide suction power for sucking garbage, here, the maintenance station body 300 is provided with a garbage receptacle 310 and a suction tube 350, the suction tube 350 is in flow communication with the suction unit 320 and is configured to guide the garbage to the garbage receptacle 310, the garbage receptacle 310 is movably mounted at a side wall of the maintenance station body 300. The garbage receptacle 310 is provided with a porous structure for ventilation with the suction unit 320, so as to achieve that the suction unit 320 sucks the garbage into the garbage receptacle 310 along the suction tube 350. Specifically, the cleaning robot 400 is provided with a garbage discharge port at a side wall, top or bottom of a robot body 410 (not limited to the manner in FIG. 1), the garbage discharge port is docked with the garbage receiving port 220 of the robot maintenance station 100, and the garbage in a dust box 420 of the cleaning robot 400 passes through the garbage discharge port, the garbage receiving port 220, and the suction tube 350 in sequence and finally enters into the garbage receptacle 310. The air flow may be referred to the direction indicated by the arrow in FIG. 1, in which the air flow passes through the garbage discharge port, the garbage receiving port 220, the suction tube 350, and the garbage receptacle 310 in sequence, and finally is discharged to outside of the robot maintenance station 100 via the suction unit 320. The garbage receptacle 310 is provided with a handle structure (not shown in the figure), and the user needs to clean the garbage receptacle 310 when the garbage in the garbage receptacle 310 is loaded to a certain amount. For convenience of description, a reference coordinate system x-z-o is introduced in FIG. 1, where x-o represents a horizontal direction or a direction parallel to the horizontal direction, and z-o represents a vertical direction or a direction parallel to the vertical direction. The term "movable" means that the user can pull the handle structure along the x-o direction in FIG. 1, i.e., the horizontal direction, and the garbage receptacle 310 is taken out from the side wall of the robot maintenance station 100, thereby achieving a detachable connection. Then, the garbage receptacle 310 is be emptied, and then the garbage receptacle 310 may be pushed along the o-x directional and is mounted at the side wall of the robot maintenance station 100.

Compared with the prior art, the present application has at least the following beneficial effects: on the one hand, the robot maintenance station 100 sucks the garbage of the cleaning robot 400 into the garbage receptacle 310 through the suction unit 320, so as to achieve automatic emptying for the dust box 420 of the cleaning robot 400, thereby reducing burden on the user and improving user experience; on the other hand, through arranging the detachable garbage receptacle 310 at the side wall of the maintenance station body 300, the garbage receptacle 310 may be pulled out from the side of the robot maintenance station 100 when the garbage receptacle 310 is filled with garbage, and thus the garbage in the robot maintenance station 100 is disposed, the operations are simple and convenient, which is beneficial for the user to regularly clean and maintain the robot maintenance station 100.

Figure 2:
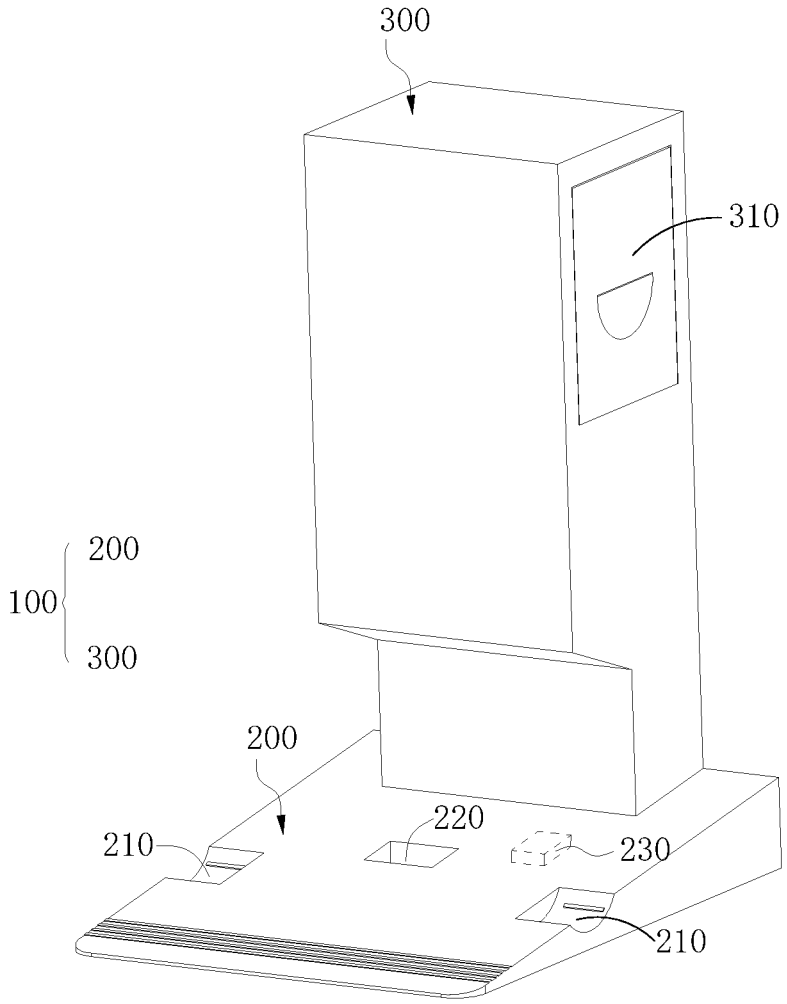
FIG. 2 is a schematic diagram of the robot maintenance station provided by an embodiment of the present application.
Figure 3:
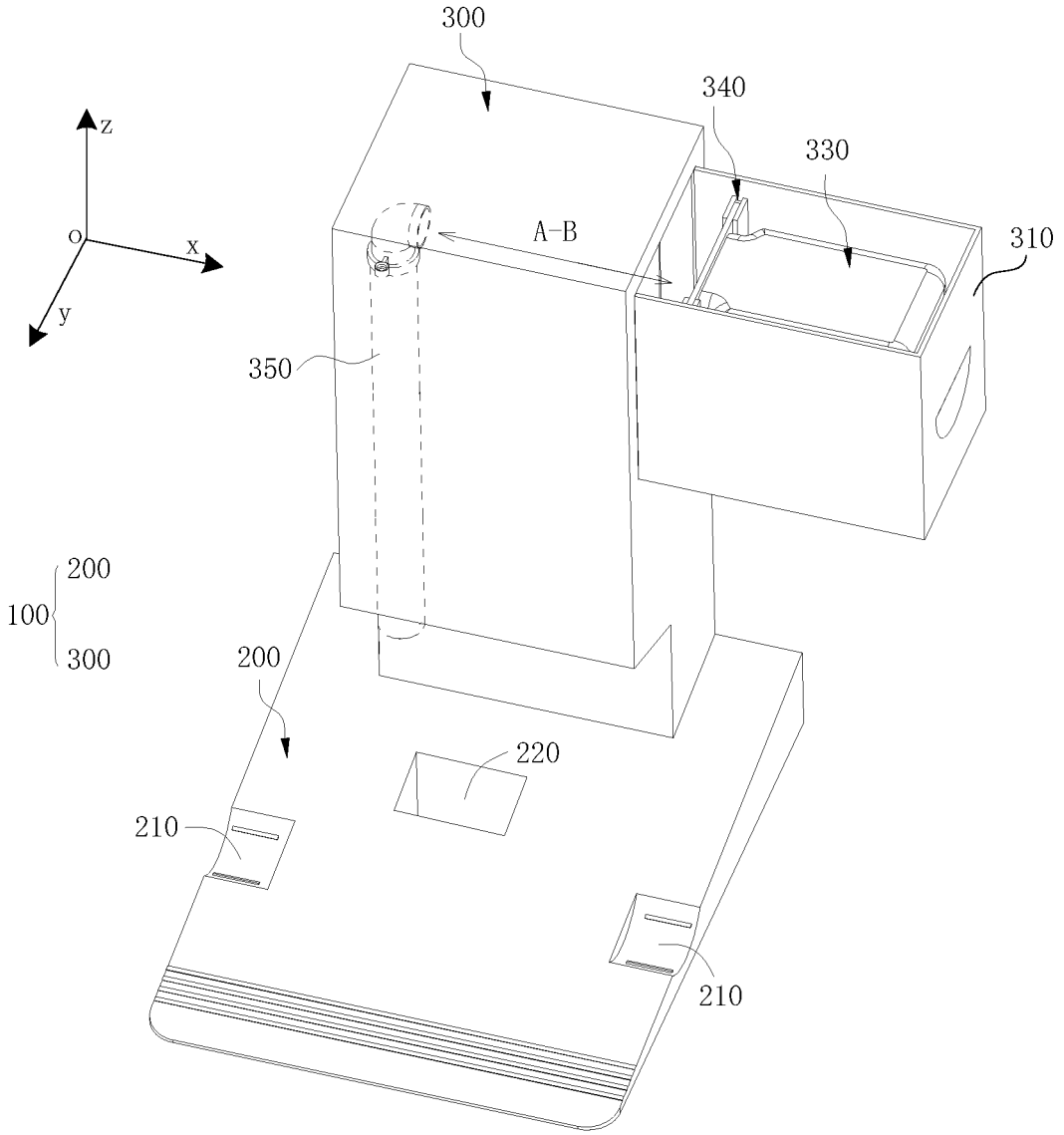
FIG. 3 is a first schematic diagram of pulling out a garbage receptacle from the robot maintenance station according to an embodiment of the present application.

Please refer to FIGS. 2 and 3. FIG. 2 is a schematic diagram of the robot maintenance station 100 provided by an embodiment of the present application, and FIG. 3 is a first schematic diagram of pulling out the garbage receptacle 310 of the robot maintenance station 100 according to an embodiment of the present application. An opening is provided along the horizontal direction on the side wall of the maintenance station body 300 to form an accommodating cavity (not shown in the figures), and the garbage receptacle 310 is detachably mounted in the accommodating cavity. When internal garbage in the garbage receptacle 310 needs to be cleaned up, the garbage receptacle 310 is moved along the o-x direction in FIG. 3 from the position A to the position B, so that the garbage receptacle 310 is exposed to the outside, and the garbage receptacle 310 may be taken out at this time for cleaning up the garbage in the garbage receptacle 310. Referring to FIG. 2, after cleaning, the garbage receptacle 310 is pushed along the x-o direction from the position B to the position A, thereby achieving that the garbage receptacle 310 is rearranged on the side wall of the robot maintenance station 100. The robot maintenance station 100 provided in the present application sucks the garbage in the cleaning robot 400 into the garbage receptacle 310 through the suction unit 320, which not only realizes automatic emptying of the dust box 420 of the cleaning robot 400, reduces the user burden, and improves the user experience. Moreover, through arranging the detachable garbage receptacle 310 at the side wall of the maintenance station body 300, when the garbage receptacle 310 is filled with garbage, the garbage receptacle 310 may be pulled out from the side of the robot maintenance station 100 to handle the garbage in the robot maintenance station 100, which is simple and convenient to operate, beneficial for users to clean up and maintain the robot maintenance station 100 on a regular basis, and improves the user experience.

Figure 4:
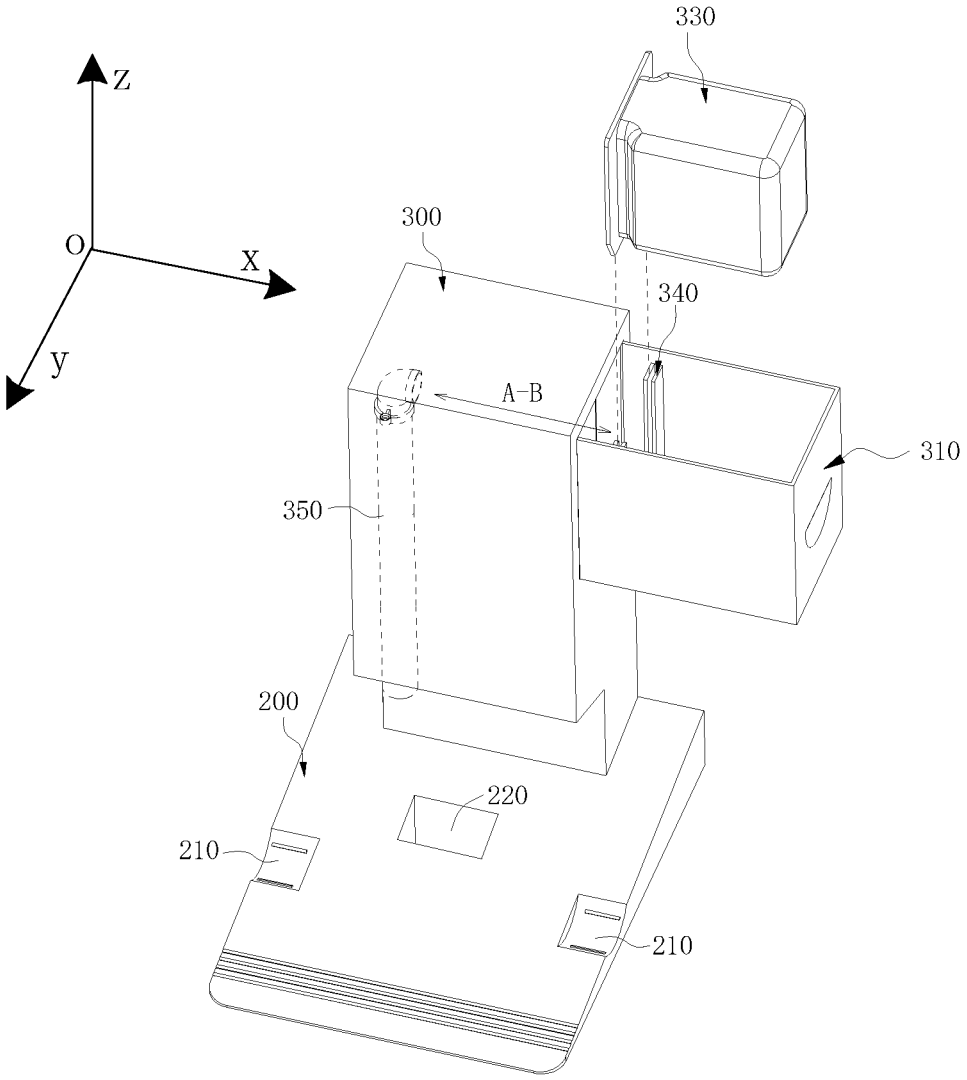
FIG. 4 is a second schematic diagram of pulling out a garbage receptacle from the robot maintenance station according to an embodiment of the present application.

As a further limitation of the present application, please refer to FIGS. 3 and 4, the robot maintenance station 100 includes a sliding assembly (not shown in the figures), and the sliding assembly includes a first sliding member and a second sliding member (not shown in the figures). The first sliding member is arranged to slide on the second sliding member, the first sliding member is arranged outside the garbage receptacle 310, and the second sliding member is arranged on an inner wall of the receiving cavity. Specifically, the garbage receptacle 310 has a rectangular parallelepiped structure, the first sliding member includes two first sliding members arranged in parallel at a bottom of the garbage receptacle 310, and the two first sliding members arranged in parallel extend along the o-x direction. The two first sliding members arranged in parallel are arranged on a bottom edge of the garbage receptacle 310, and the two first sliding members arranged in parallel may also be designed as four or six sliding members arranged in parallel on the bottom edge of the garbage receptacle 310, such that the movable connection between the garbage receptacle 310 and the side wall of the robot maintenance station 100 is more reliable and smooth.

As a preference, one of the first sliding member and the second sliding member is a guide rail, and the other is arranged as a sliding block sliding on the guide rail. Specifically, the garbage receptacle 310 has a rectangular parallelepiped structure, the first sliding member includes two first sliding members arranged in parallel at the bottom of the garbage receptacle 310, and the two first sliding members arranged in parallel extend along the o-x direction. The two first sliding members arranged in parallel are arranged on the bottom edge of the garbage receptacle 310, and the two first sliding members arranged in parallel may also be designed as four or six sliding members arranged in parallel on the bottom edge of the garbage receptacle 310, such that the movable connection between the garbage receptacle 310 and the side wall of the robot maintenance station 100 is more reliable and smooth. Through arranging the first sliding member on the edge of the garbage receiving box 310 and the second sliding member on the inner wall of the receiving cavity, the garbage receptacle 310 can achieve slide on the inner wall of the receiving cavity, so that the garbage receptacle 310 can be pulled out from the side of the robot maintenance station 100 to dispose the garbage in the robot maintenance station 100, which is simple and convenient to operate, beneficial for users to clean up and maintain the robot maintenance station 100 on a regular basis, and improves the user experience.

Optionally, one of the first sliding member and the second sliding member is a sliding groove, and the other is a sliding rod arranged to move along the sliding groove. Specifically, the garbage receptacle 310 has a rectangular parallelepiped structure, the first sliding member includes two first sliding members arranged in parallel at the bottom of the garbage receptacle 310, and the two first sliding members arranged in parallel extend along the o-x direction. The two first sliding members arranged in parallel are arranged on the bottom edge of the garbage receptacle 310, and the two first sliding members arranged in parallel may also be designed as four or six sliding members arranged in parallel on the bottom edge of the garbage receptacle 310, such that the movable connection between the garbage receptacle 310 and the side wall of the robot maintenance station 100 is more reliable and smooth, thereby making the operation that the users take out the garbage receptacle 310 simple and convenient, which is beneficial for the users to clean up and maintain the robot maintenance station 100 on a regular basis and improves the user experience.

As a further limitation of the present application, please refer to FIG. 1 again, the garbage receptacle 310 is provided with a docking port (not shown in the figure), when the garbage receptacle 310 is mounted in the receiving cavity, one end of the suction tube 350 extends into the docking port and is connected to the docking port in a sealed manner. The docking port is roughly circular, and the size of its opening is adapted to the size of the opening of the end of the suction tube 350. A sealant may be arranged at the docking port, when the suction tube 350 is inserted into the docking port, the sealant seals a gap jointed between the suction tube 350 and the docking port, thereby ensuring that the connection between the suction tube 350 and the garbage receptacle 310 has good air tightness.

Optionally, the garbage receptacle 310 is provided with a docking portion (not shown in the figure), and the docking portion protrudes out from the garbage receptacle 310. When the garbage receptacle 310 is mounted in the receiving cavity, the docking portion mates with one end of the suction tube 350 which is close to the garbage receptacle 310, so as to form a sealed connection. The docking portion protrudes from the outside of the garbage receptacle 310, so that the connection between the garbage receptacle 310 and the suction tube 350 has good sealing, thereby avoiding air leakage and loss of suction power, and making the robot maintenance station 100 be capable of sucking the garbage in the cleaning robot 400 into the garbage receptacle 310 better.

As a further limitation of the present application, please refer to FIGS. 3 and 4, the garbage receptacle 310 is provided with a garbage bag 330 and a stand 340 therein, the garbage bag 330 is configured to store the garbage sucked in by the suction unit 320, and the garbage bag 330 is detachably mounted on the stand 340.

Figure 7:
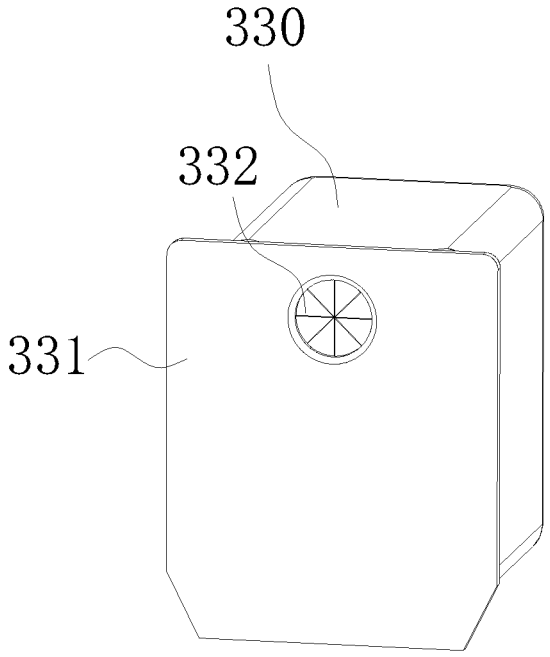
FIG. 7 is a schematic diagram of a garbage bag provided by an embodiment of the present application.

As a further limitation of the present application, please refer to FIGS. 4 and 7, FIG. 7 is a schematic diagram of the garbage bag 330 provided by an embodiment of the present application. The garbage bag 330 includes a bag mouth and a lateral plate 331, as shown in FIG. 4. The lateral plate 331 is arranged at a side opposite to the inner side of the garbage receptacle 310, and the garbage bag 330 is inserted into the chute of the stand 340 along the direction indicated by the dotted line in FIG. 4, to realize mounting the garbage bag 330 into the garbage receptacle 310. The state that the garbage bag 330 is mounted in the garbage receptacle 310 may refer to FIG. 3, when the garbage receptacle 310 is mounted in the receiving cavity, one end of the suction tube 350 extends into the bag mouth, and the bag mouth is provided with a flexible rubber seal 332. Specifically, the flexible rubber seal 332 may be selected as an elastic sealant, and the flexible rubber seal 332 is composed of a plurality of deformable fan blades, and the fan blades may take the form of three leaves, four leaves, six leaves, eight leaves, etc. When the suction tube 350 is inserted into the bag mouth, the elastic sealant may seal the bag mouth well, when the suction tube 350 is pulled out from the bag mouth, the plurality of fan blades of the elastic sealant may be automatically rearranged to prevent the garbage inside the garbage bag 330 from spilling out, thereby improving the tightness of the garbage bag 330.

As a further limitation of the present application, the suction unit 320 is in flow communication with the garbage receptacle 310, the garbage receptacle 310 is provided with a strainer unit, and the suction unit 320 is arranged above or below the garbage receptacle 310.

Figure 5:
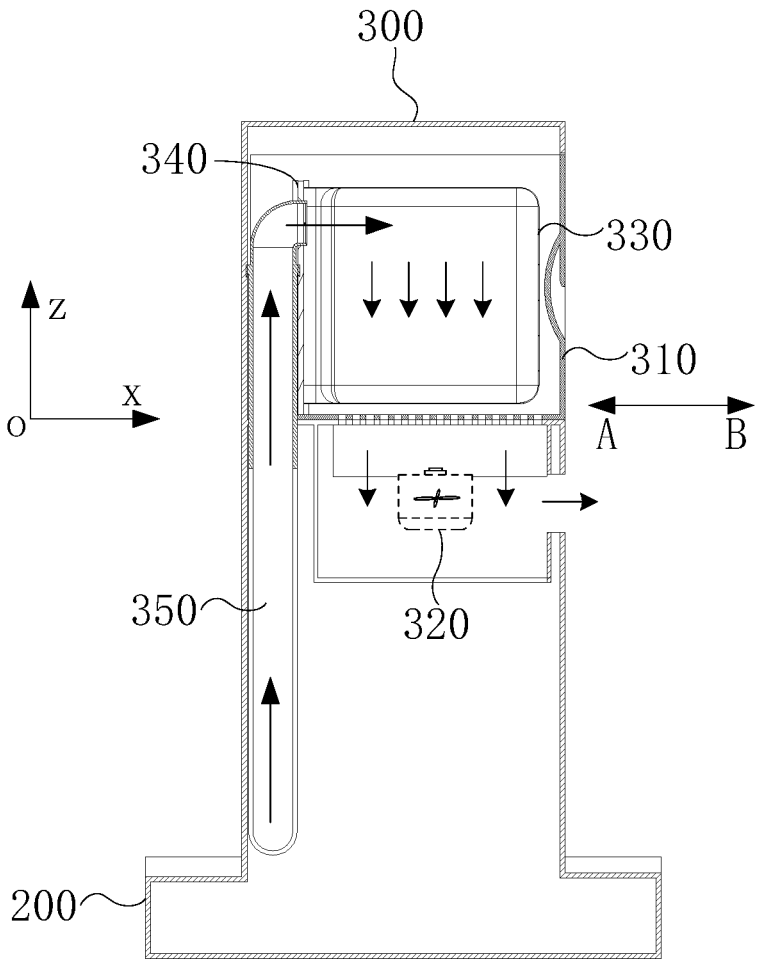
FIG. 5 is a schematic diagram of gas flow inside the robot maintenance station provided by an embodiment of the present application.
Figure 6:
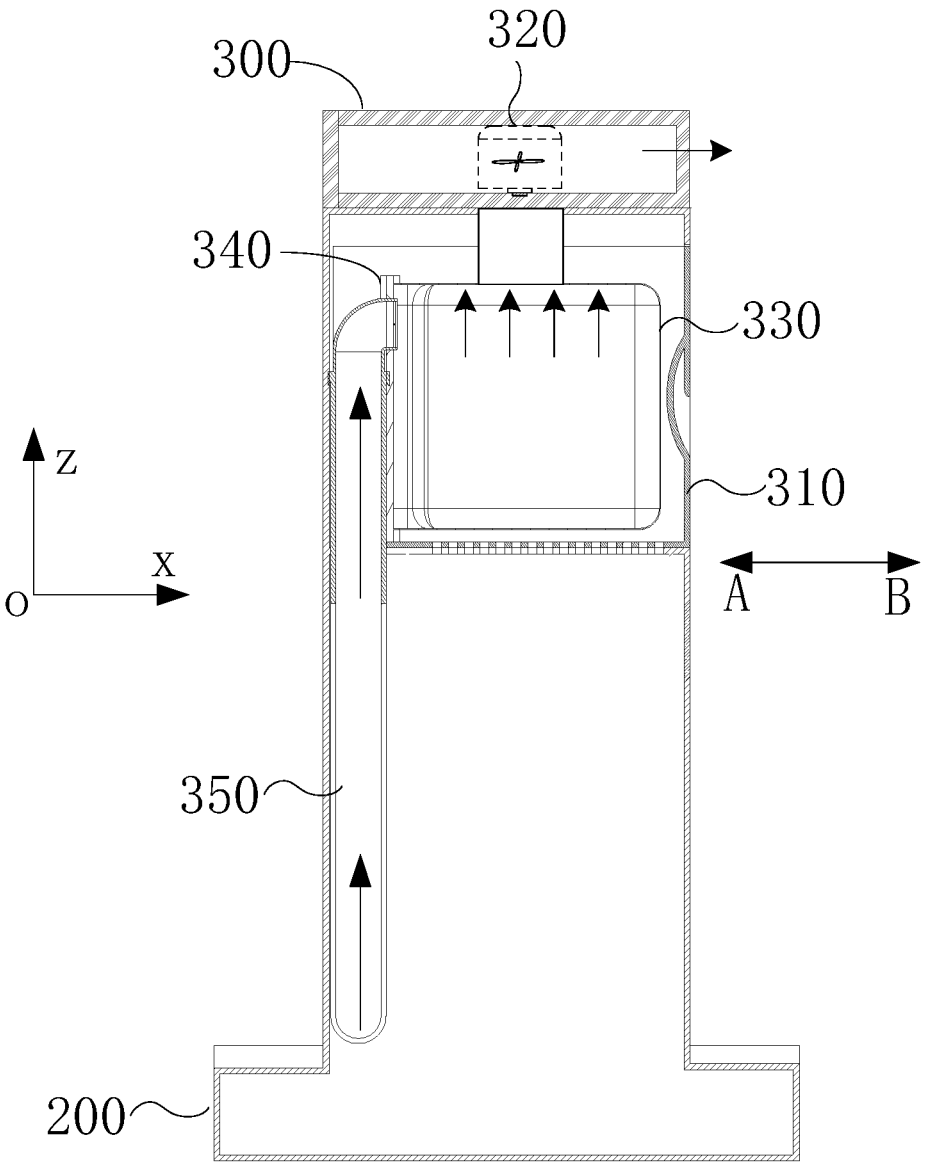
FIG. 6 is another schematic diagram of the gas flow inside the robot maintenance station provided by an embodiment of the present application.

When the suction unit 320 is arranged below the garbage receptacle 310, please refer to FIG. 5, the flow direction of the air in the robot maintenance station 100 is indicated by the arrow in FIG. 5. Specifically, the air flows through the suction tube 350, the garbage receptacle 310, the garbage bag 330, and the suction unit 320 in turn, and is finally discharged to the outside through the side wall of the robot maintenance station 100. Optionally, please refer to FIG. 6, the suction unit 320 is arranged above the receiving cavity (garbage receptacle 310), the air passes through the suction tube 350, the garbage receptacle 310, the garbage bag 330, and the suction unit 320, and is finally discharged to the outside through the side wall of the robot maintenance station 100. In the above two manners, the garbage bag 330 may be arranged in the garbage receptacle 310, or the garbage bag 330 may be removed. FIGS. 5 and 6 are only embodiments for reference, and that the direction of the garbage bag 330 is not limit is also within the protection scope of the present application. It is worth noting that, in the above two solutions, when the suction unit 320 is arranged below the garbage receptacle 310, a strainer unit for ventilation is arranged at the bottom of the garbage receptacle 310, correspondingly, when the suction unit 320 is arranged above the garbage receptacle 310, the strainer unit for ventilation is arranged at the top of the garbage receptacle 310, thereby realizing the flow communication between the garbage receptacle 310 and the suction unit 320.

A second aspect of the present application further provides a robot cleaning system. The robot cleaning system includes the cleaning robot 400 and the robot maintenance station 100, and the robot maintenance station 100 is the robot maintenance station 100 according to any one of the above embodiments.

Please refer to FIG. 1 again, the cleaning robot 400 includes the robot body 410, and a bottom of the robot body 410 is provided with a driving unit, the driving unit is configured to be dockable with the cleaning robot 400 to move on a surface to be cleaned.

As a further limitation of the present application, the cleaning robot 400 includes a controller, a fan unit 430, a dust box 420, and a dust sensor. The dust sensor is configured to detect garbage volume in the dust box 420, the controller is electrically connected to the dust sensor, and the dust sensor is configured to detect dust volume and transmit information to the controller. The controller is at least configured to control the cleaning robot 400 to move toward the robot maintenance station 100 when the garbage volume reaches a threshold.

As a further limitation of the present application, the robot maintenance station 100 includes a signal transmitter for sending a docking signal. The cleaning robot 400 includes a signal receiver for receiving the docking signal, and the controller is at least configured to control the cleaning robot 400 to be docked with the robot maintenance station 100 according to the docking signal.

As a further limitation of the present application, the dust box 420 is provided with a garbage discharge port. Please refer to FIGS. 1 and 2, the robot maintenance station 100 is provided with the garbage receiving port 220, when the cleaning robot 400 moves to the dock base 200 and is docked with the robot maintenance station 100, the garbage discharge port is aligned with the garbage receiving port 220.

As a further limitation of the present application, the robot maintenance station 100 includes a control module, and the dock base 200 is provided with a position detection sensor. When the cleaning robot 400 moves to the dock base 200 and is docked with the robot maintenance station 100, the driving unit triggers the position detection sensor, the position detection sensor transmits an electric signal to the control module, and the control module controls the suction unit 320 of the robot maintenance station 100 to suck in garbage. Please refer to FIG. 2 again. The position detection sensor includes a pressure sensor 230 and a light detection sensor (not shown in the figure). When the cleaning robot 400 moves to the dock base 200, pressure of an upper side detected by the pressure sensor 230 is changed, and the electrical signal is transmitted to the control module, the light detection sensor detects whether the cleaning robot 400 has reached a designated garbage discharge position. The dock base 200 is provided with a sunken portion 210, the sunken portion 210 is configured to fix the cleaning robot 400 on the dock base 200 to avoid the cleaning robot 400 retreating unexpectedly.

In the description of this specification, the description with reference to the term "one embodiment", "some embodiments", "examples", "specific examples", or "some examples" etc. means that a specific feature, structure, material or characteristic, described in conjunction with the embodiment or example, is included in at least one embodiment or example of the present application. In this specification, the schematic representations of the above terms do not necessarily refer to the same embodiment or example. Moreover, the described specific feature, structure, material, or characteristic may be combined in an appropriate manner in any one or more embodiments or examples. In addition, those skilled in the art may combine and group the different embodiments or examples described in this specification, and the features of the different embodiments or examples described in this specification, without contradicting each other.

The above description only describes preferred embodiments of the present application and is not intended to limit the present application. Any modification, equivalent replacement and improvement made within the spirit and principle of the present application shall be included in the protection scope of the present application.

What is claimed is:

1. A robot maintenance station for maintenance of a cleaning robot, comprising:

a dock base, configured to be dockable with the cleaning robot, and a maintenance station body, arranged in operable connection with the dock base and provided with a suction unit, wherein the suction unit is configured to provide suction power for sucking garbage, the maintenance station body is provided with a garbage receptacle and a suction tube, the suction tube is in flow communication with the suction unit and is configured to guide the garbage into the garbage receptacle, the garbage receptacle is removably mounted at a side wall of the maintenance station body, an opening is provided on the maintenance station body to form an accommodating cavity, the garbage receptacle is removably mounted in the accommodating cavity, the garbage receptacle is provided with a garbage bag and a stand, the garbage bag is configured to store the garbage sucked in by the suction unit, and the garbage bag is detachably mounted on the stand.

2. The robot maintenance station according to claim 1, wherein the opening is provided along a horizontal direction on the side wall of the maintenance station body to form an accommodating cavity, and the garbage receptacle is removably mounted in the accommodating cavity.

3. The robot maintenance station according to claim 1, further comprising:

a sliding assembly which is configured to reduce a frictional force when the garbage receptacle is moving relative to the maintenance station body.

4. The robot maintenance station according to claim 3, wherein the robot maintenance station comprises a sliding assembly comprising a first sliding member and a second sliding member, the first sliding member is arranged to slide on the second sliding member, the first sliding member is arranged outside the garbage receptacle, and the second sliding member is arranged on an inner wall of the receiving cavity.

5. The robot maintenance station according to claim 1, wherein the garbage receptacle is provided with a docking port, and one end of the suction tube extends into the docking port and is connected to the docking port in a sealed manner when the garbage receptacle is mounted in the receiving cavity.

6. The robot maintenance station according to claim 1, wherein the garbage receptacle is provided with a docking portion protruding out from the garbage receptacle, and, when the garbage receptacle is mounted in the receiving cavity, the docking portion mates with one end of the suction tube close to the garbage receptacle to form a sealed connection.

7. The robot maintenance station according to claim 1, wherein the garbage bag comprises a bag mouth, and, when the garbage receptacle is mounted in the receiving cavity, one end of the suction tube close to the garbage receptacle extends into the bag mouth, the bag mouth is provided with a flexible rubber seal, and the flexible rubber seal is composed of a plurality of deformable fan blades.

8. The robot maintenance station according to claim 1, wherein the suction unit is in flow communication with the garbage receptacle, the garbage receptacle is provided with a strainer unit, and the suction unit is arranged above or below the garbage receptacle.

9. A robot cleaning system, comprising a cleaning robot and a robot maintenance station, the robot maintenance station comprising:

a dock base, configured to be dockable with the cleaning robot, and a maintenance station body, arranged in operable connection with the dock base and provided with a suction unit, wherein the suction unit is configured to provide suction power for sucking garbage, the maintenance station body is provided with a garbage receptacle and a suction tube, the suction tube is in flow communication with the suction unit and is configured to guide the garbage into the garbage receptacle, the garbage receptacle is removably mounted at a side wall of the maintenance station body, an opening is provided on the maintenance station body to form an accommodating cavity, the garbage receptacle is removably mounted in the accommodating cavity, the garbage receptacle is provided with a garbage bag and a stand, the garbage bag is configured to store the garbage sucked in by the suction unit, the garbage bag is detachably mounted on the stand, the cleaning robot comprises a robot body, a bottom of the robot body is provided with a driving unit, and the driving unit is configured to be dockable with the cleaning robot to move on a surface to be cleaned.

10. The robot cleaning system according to claim 9, wherein the cleaning robot comprises a controller, a dust box, and a dust sensor, the dust sensor is configured to detect garbage volume in the dust box, the controller is electrically connected to the dust sensor, and the controller is at least configured to control the cleaning robot to move toward the robot maintenance station when the garbage volume reaches a threshold.

11. The robot cleaning system according to claim 10, wherein the robot maintenance station comprises a signal transmitter for sending a docking signal, the cleaning robot comprises a signal receiver for receiving the docking signal, and the controller is at least configured to control the cleaning robot to be docked with the robot maintenance station according to the docking signal.

12. The robot cleaning system according to claim 10, wherein the dust box is provided with a garbage discharge port, the robot maintenance station is provided with the garbage receiving port, and the garbage discharge port is aligned with the garbage receiving port when the cleaning robot moves to the dock base and is docked with the robot maintenance station.

13. The robot cleaning system according to claim 9, wherein the robot maintenance station comprises a control module, and the dock base is provided with a position detection sensor, when the cleaning robot moves to the dock base and is docked with the robot maintenance station, the driving unit triggers the position detection sensor, the position detection sensor transmits an electric signal to the control module, and the control module controls the suction unit of the robot maintenance station to suck in garbage.

14. The robot maintenance station according to claim 9, wherein an opening is provided on the maintenance station body to form an accommodating cavity, and the garbage receptacle is removably mounted in the accommodating cavity.

15. The robot cleaning system according to claim 14, wherein the opening is provided along a horizontal direction on the side wall of the maintenance station body to form an accommodating cavity, and the garbage receptacle is removably mounted in the accommodating cavity.

16. The robot maintenance station according to claim 14, wherein the robot maintenance station comprises a sliding assembly which is configured to reduce the frictional force when the garbage receptacle is moving relative to the maintenance station body.

17. The robot cleaning system according to claim 14, wherein the garbage receptacle is provided with a docking port, and one end of the suction tube extends into the docking port and is connected to the docking port in a sealed manner when the garbage receptacle is mounted in the receiving cavity.

18. The robot cleaning system according to claim 14, wherein the garbage receptacle is provided with a docking portion protruding out from the garbage receptacle, when the garbage receptacle is mounted in the receiving cavity, the docking portion mates with one end of the suction tube close to the garbage receptacle to form a sealed connection.

* * * * *